US007513233B2

(12) United States Patent
Ichimura et al.

(10) Patent No.: US 7,513,233 B2
(45) Date of Patent: Apr. 7, 2009

(54) VARIABLE VALVE TIMING CONTROLLER FOR INTERNAL COMBUSTION ENGINE

(75) Inventors: Kazuki Ichimura, Anjo (JP); Yasuo Hirata, Chita-gun (JP)

(73) Assignee: Denso Corporation, Kariya (JP)

( * ) Notice: Subject to any disclaimer, the term of this patent is extended or adjusted under 35 U.S.C. 154(b) by 97 days.

(21) Appl. No.: 11/822,927

(22) Filed: Jul. 11, 2007

(65) Prior Publication Data

US 2008/0029050 A1 Feb. 7, 2008

(30) Foreign Application Priority Data

Aug. 1, 2006 (JP) ..... 2006-209382

(51) Int. Cl.
*F01L 1/34* (2006.01)

(52) U.S. Cl. ..... 123/90.17; 123/90.15; 123/347; 464/160

(58) Field of Classification Search ..... 123/90.15, 123/90.16, 90.17, 90.18, 90.27, 90.31, 347, 123/348; 464/1, 2, 160
See application file for complete search history.

(56) References Cited

U.S. PATENT DOCUMENTS 6,647,935 B2 * 11/2003 Aoyama et al. ..... 123/90.16
6,928,968 B2 8/2005 Ichimura et al.

* cited by examiner

*Primary Examiner*—Ching Chang
(74) *Attorney, Agent, or Firm*—Nixon & Vanderhye PC

(57) ABSTRACT

In a case of switching the control mode between the reference timing control mode and the F/B control mode, when an engine speed is greater than or equal to a predetermined speed, and when target advanced amount of intake valve timing is lower than a switching threshold (vicinity of the most retarded timing), an intake VCT is switched into the reference timing control mode. And when engine speed is more than the predetermined rotating speed, and when the target retarded amount of exhaust valve timing is less than the switching threshold (vicinity of the most advanced timing), an exhaust VCT is switched to the reference timing control mode.

5 Claims, 7 Drawing Sheets

VARIABLE VALVE TIMING CONTROLLER FOR INTERNAL COMBUSTION ENGINE

CROSS-REFERENCE TO RELATED APPLICATION

This application is based on Japanese Patent Application No. 2006-209382 filed on Aug. 1, 2006, the disclosure of which is incorporated herein by reference.

FIELD OF THE INVENTION

The present invention relates to the variable valve timing controller for an internal combustion engine having a hydraulic variable valve timing device which varies a valve timing of an intake valve and/or an exhaust valve of the internal combustion engine.

BACKGROUND OF THE INVENTION

It is known that a hydraulic variable valve timing device varies a valve timing (opening/closing timing) of an intake valve and/or an exhaust valve for an output improvement of the internal combustion engine, fuel consumption reduction, and exhaust emission reduction. The following control is performed in a system including the variable valve timing device. When the target advanced amount of valve timing is less than a switching threshold, an amount of oil pressure control (control duty value) is controlled to a specified value so that a control mode is switched to a reference timing control mode in which an actual valve timing (actual advanced amount of valve timing) is hold at a reference timing. The switching threshold is established near the reference timing. When target advanced amount exceeds the switching threshold, the amount of oil pressure control is switched to the F/B control mode which performs feedback ("F/B") control so that the difference of an actual valve timing and the target valve timing is decreased.

However, in the system which includes both an intake variable valve timing device and an exhaust variable valve timing device and supplies hydraulic pressure with a single hydraulic pump common to the oil pressure regulating valve of the intake side and the exhaust side, there are following problems. Namely, while one variable valve timing device is controlled by the F/B control mode, when the control mode of the other is switched, the hydraulic pressure (capacity) supplied to one variable valve timing device may be fluctuated. The actual valve timing may be fluctuated owing to this, and a drivability and an exhaust emission may be deteriorated.

In order to solve the above problems, JP-2005-98150A (U.S. Pat. No. 6,928,968B2) shows following system. When the target valve timing of at least one variable valve timing device is brought into the F/B control mode, the control modes of both variable valve timing devices are simultaneously switched to the F/B control mode. When the target valve timings of both variable valve timing devices are brought into the reference timing control mode, the control modes of the variable valve timing devices are simultaneously switched to the reference timing control mode. Thereby, while one variable valve timing device is controlled in the F/B control mode, it is prevented that the control mode of the other variable valve timing device is switched.

When the variable valve timing device is controlled in the reference timing control mode as shown in FIG. 2B, the amount of oil pressure control is controlled to the specified value so that the moving element of the variable valve timing device is pressed against the stopper part. Thereby, since actual valve timing is held in the reference timing, for example, most retarded timing, the circulation amount of the oil (oil leakage) increases and the amount of oil storage in the oil pan decreases.

On the other hand, when the variable valve timing device is controlled in the F/B control mode as shown in FIG. 2A, the F/B control of oil pressure control is performed so that the difference between the actual valve timing and the target valve timing may be decreased. Thereby, since actual valve timing is controlled at a vicinity of the target valve timing, the oil circulation amount (oil supply to the variable valve timing device) decreases, and the of oil storage amount in the oil pan increases. Hence, most of the crankshaft may be immersed in the oil stored in the oil pan, the mechanical rotational resistance of the crankshaft may increase, the torque loss of the internal combustion engine may increase, and the output may be deteriorated.

However, in the system shown in JP-2005-98150A, there is a problem that the period in which the variable valve timing device is controlled in the F/B control mode is prolonged, so that the power of the engine is deteriorated due to the increase in the oil storage amount.

SUMMARY OF THE INVENTION

The present invention is made in view of the above matters, and it is an object of the present invention to provide a variable valve timing controller for an internal combustion engine which can reduce the F/B control mode period in which the engine output is deteriorated due to an increase of the oil storage amount.

According to the present invention, a variable valve timing controller for an internal combustion engine having a hydraulic variable valve timing device which hydraulically varies a valve timing of an intake valve and/or an exhaust valve of the internal combustion engine includes a control mode switching means. The control mode switching means switches a control mode of the hydraulic variable valve timing device between a reference timing control mode and a feedback control mode. In the reference timing control mode, hydraulic pressure is controlled to a specified value so that an actual valve timing is brought into a reference timing. In the feedback control mode, the hydraulic pressure is feedback controlled so that a difference between the actual valve timing and a target valve timing is decreased. The control mode switching means switches the control mode of the variable valve timing device to the reference timing control mode, when the rotating speed of the internal combustion engine is greater than or equal to a specified value.

In the system that the target valve timing is established as the reference timing (the most retarded timing of an intake variable valve timing device, for example) or its vicinity in the operating range where the engine speed is relatively high, when the engine speed exceeds a predetermined value, the variable valve timing device is switched into the reference timing control mode so that the actual valve timing is controlled to the reference timing (the target valve timing or its vicinity). According to this structure, the period in which the variable valve timing device is controlled in the F/B control mode can be decreased, and the period in which the engine power is deteriorated due to the increase of oil storage amount is decreased.

DETAILED DESCRIPTION OF EMBODIMENT

An embodiment of the present invention will be described hereinafter.

Figure 1:
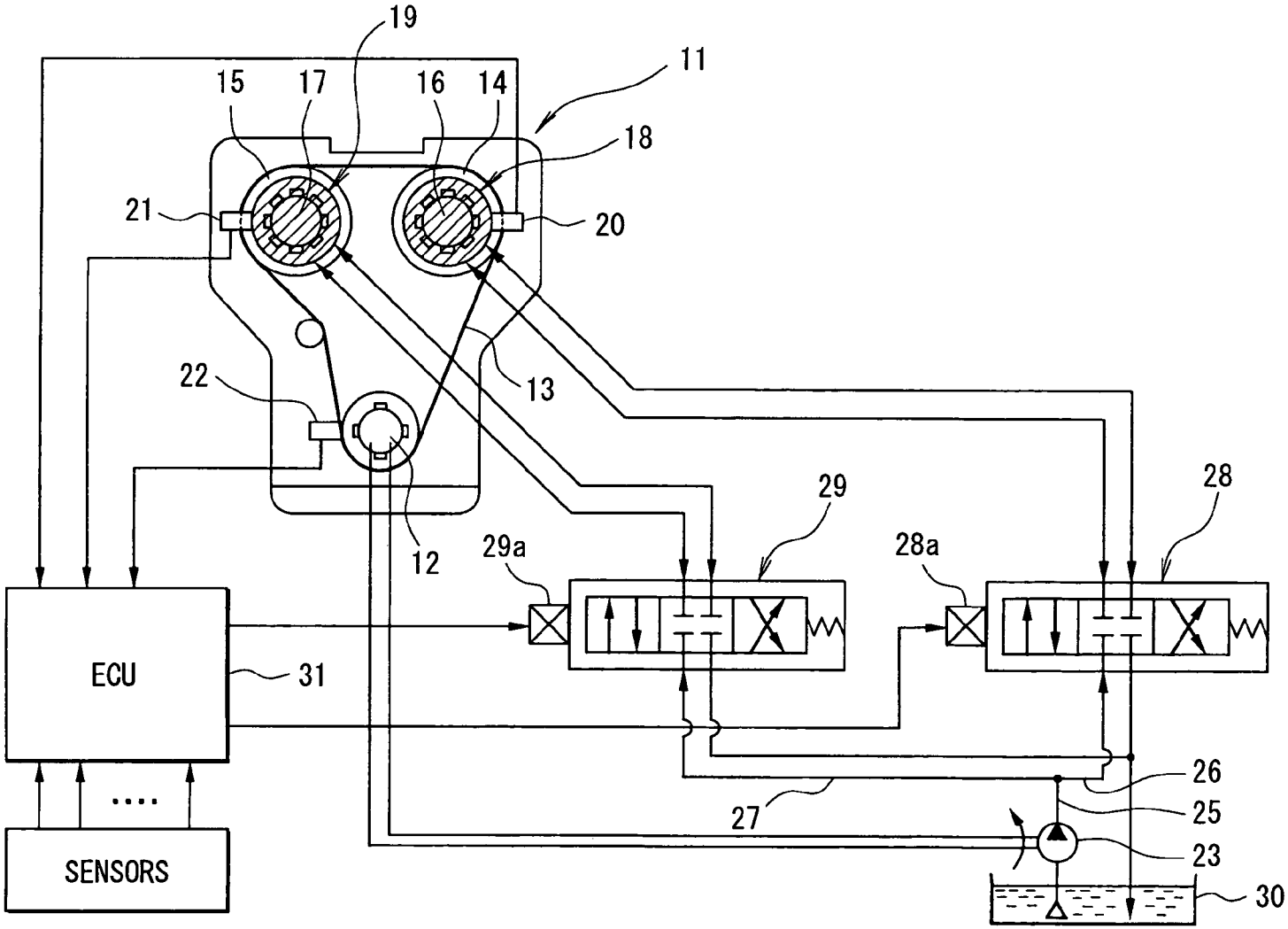
FIG. 1 is a schematic view showing a variable valve timing control system in an embodiment of the present invention.

FIG. 1 is a schematic diagram showing the whole variable valve timing control system. A power of engine 11 is transmitted to an intake camshaft 16 and an exhaust camshaft 17 via a timing chain 13 (or a timing belt) and sprockets 14 and 15 from a crankshaft 12.

A hydraulic variable valve timing device 18, which is referred to as an intake VCT 18, is provided in the intake camshaft 16. The intake VCT 18 advances the rotational phase of the intake camshaft 16 relative to the crankshaft 12, so that a valve timing of the intake valve (not shown) is advanced from the most retarded position. A hydraulic exhaust variable valve timing device 19, which is referred to as an exhaust VCT 19, is provided in the exhaust camshaft 17. The exhaust VCT 19 retards the rotational phase of the intake camshaft 16 relative to the crankshaft 12, so that a valve timing of the exhaust valve (not shown) is retarded from the most advanced position.

An intake cam angle sensor 20 which outputs intake cam angle signals for every predetermined cam angle is attached to an outer circumference of the intake cam shaft 16. An exhaust cam angle sensor 21 which outputs exhaust cam angle signals for every predetermined cam angle is attached to an outer circumference of the exhaust cam shaft 17. A crank angle sensor 22 which outputs crank angle signals for every predetermined crank angle is attached to an outer circumference of the crankshaft 12.

A hydraulic pump 23 is driven with a driving force from the crankshaft 12. A hydraulic pipe 25, which is connected to an outlet of the hydraulic pump 23, is branched into individual hydraulic pipes 26 and 27. An oil pressure regulating valve 28 of intake VCT 18 is connected to the individual hydraulic pipe 26, and an oil pressure regulating valve 29 of exhaust side VCT 19 is connected to the individual hydraulic pipe 27. The hydraulic pump 23 pumps up the oil from an oil pan 30, and feeds the oil to each oil pressure regulating valves 28 and 29.

Each oil pressure regulating valves 28 and 29 are the electromagnetic valves driven by solenoids 28*a* and 29*a*. The operation of each VCT 18 and 19 is controlled by a duty control of the energization to each oil pressure regulating valves 28 and 29. That is, the amount of the oil supplied to advance chambers and retard chambers of each VCT 18 and 19 is varied by varying a control duty value Duty of each oil pressure regulating valves 28 and 29 to vary the driving current of each valves 28 and 29.

The outputs of above sensors 20-22 and other sensors are inputted into engine controlling unit 31 (ECU). The ECU31 executes various kinds of engine control programs which are stored in a ROM. A fuel injection amount and an ignition timing of the ignition plug (not shown) are controlled in accordance with the engine operation condition.

Moreover, the ECU31 executes each program for valve timing control shown in FIGS. 3 to 8. The control mode of the intake VCT 18 and the exhaust side VCT19 is switched between a reference position control mode and a F/B control mode.

When the intake VCT 18 is the reference position control mode, the control duty value Duty1 of the oil pressure regulating valve 28 is adjusted so that the driving current becomes the most retarded current value. Thereby, the actual valve timing of the intake valve is established as the most retarded timing (reference timing). When the exhaust VCT 19 is in the reference timing control mode, the control duty value Duty2 of the oil pressure regulating valve 29 is controlled so that the driving current becomes the most advanced current value. Thereby, the actual valve timing of the exhaust valve is established as the most advanced timing (reference timing).

When the intake VCT 18 is in the F/B control mode, the control duty value Duty1 of the oil pressure regulating valve 28 is adjusted so that the difference between a target advanced amount VTT1 and an actual advanced amount VT1 of the intake valve timing are decreased. When exhaust VCT19 is in the F/B control mode, the control duty value Duty2 of the oil pressure regulating valve 29 is adjusted so that the difference between the target retarded amount VTT2 and the actual retarded amount of the exhaust valve timing are decreased.

Figure 2B:
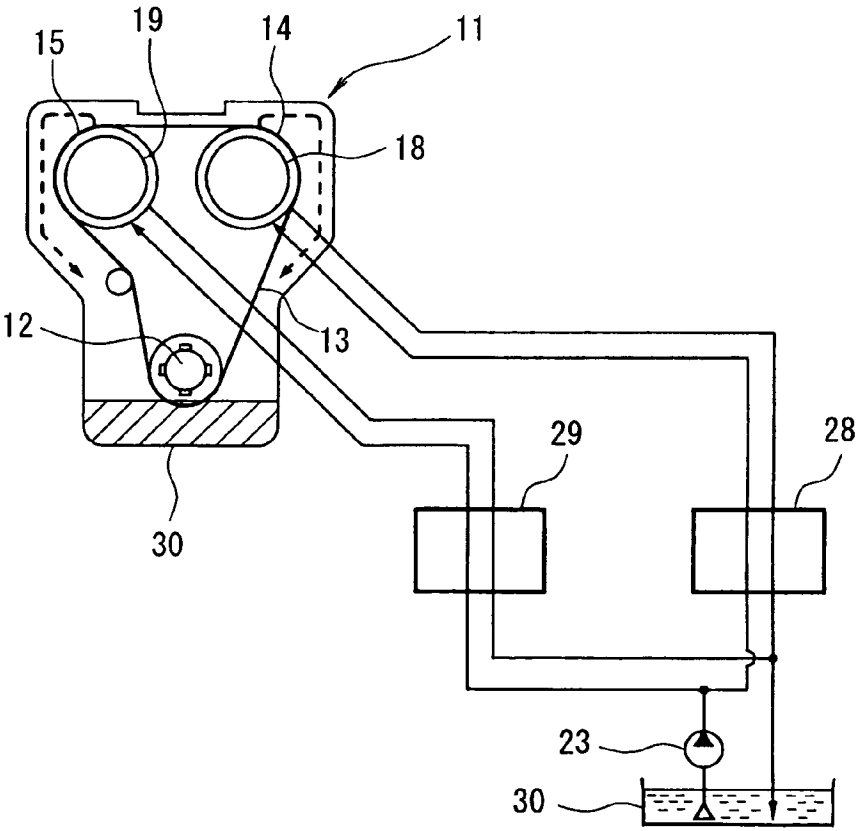
FIG. 2B is the chart for explaining the condition of the oil at the time of the reference timing control mode.

As shown in FIG. 2B, when the intake VCT 18 and the exhaust VCT 19 are controlled in the reference timing control mode, the control duty values of the oil pressure regulating valves 28, 29 are controlled to the specified value and the moving elements of the intake VCT 18 and the exhaust VCT 19 are pressed against stopper parts, so that the actual valve timing is held to most retarded timing (reference timing).

Hence, the amount of circulation of oil (oil supply to each VCT 18 and 19) increases, and the amount of oil storage in the oil pan mechanism 30 decreases.

Figure 2A:
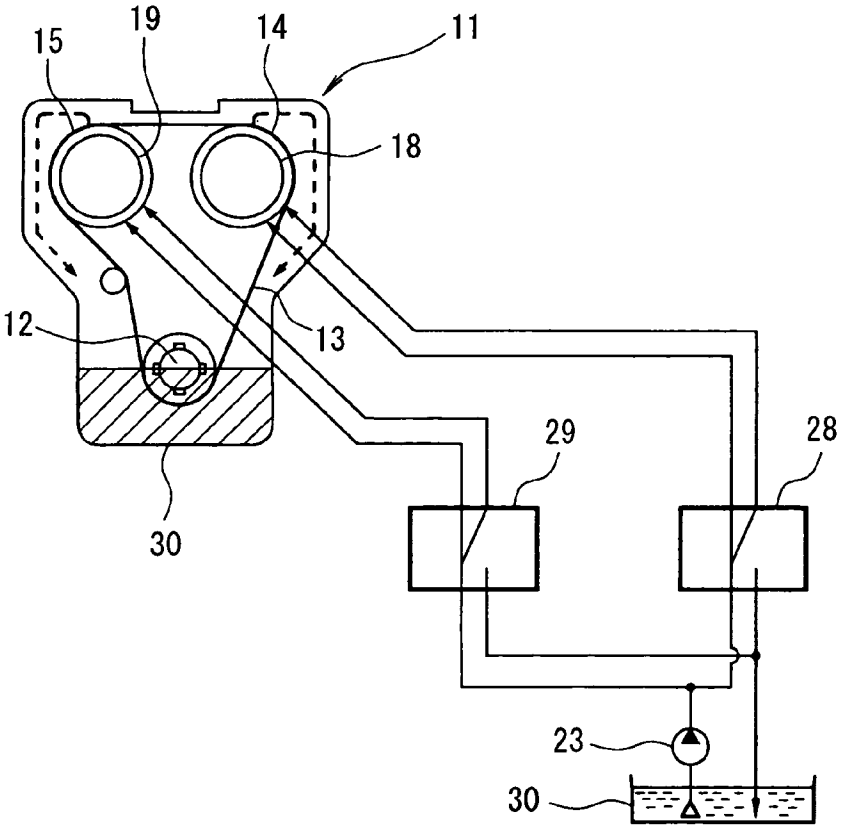
FIG. 2A is a chart for explaining the condition of the oil at the time of the F/B control mode.

As shown in FIG. 2A, when the intake VCT 18 and the exhaust VCT 19 are controlled in the F/B control mode, the control duty values of the oil pressure regulating valve 28 and 29 are controlled so that the difference between the actual valve timing and the target valve timing is decreased. Hence the actual valve timing is controlled near the target valve timing, the amount of circulation of the oil decreases, and the amount of oil storage in the oil pan mechanism 30 increases. The crankshaft 12 of the engine 11 is immersed in the oil stored in the oil pan 30, the mechanical rotational resistance of the crankshaft 12 may become large, the torque loss of the engine 11 may increase, and the output may be lowered.

Figure 10:
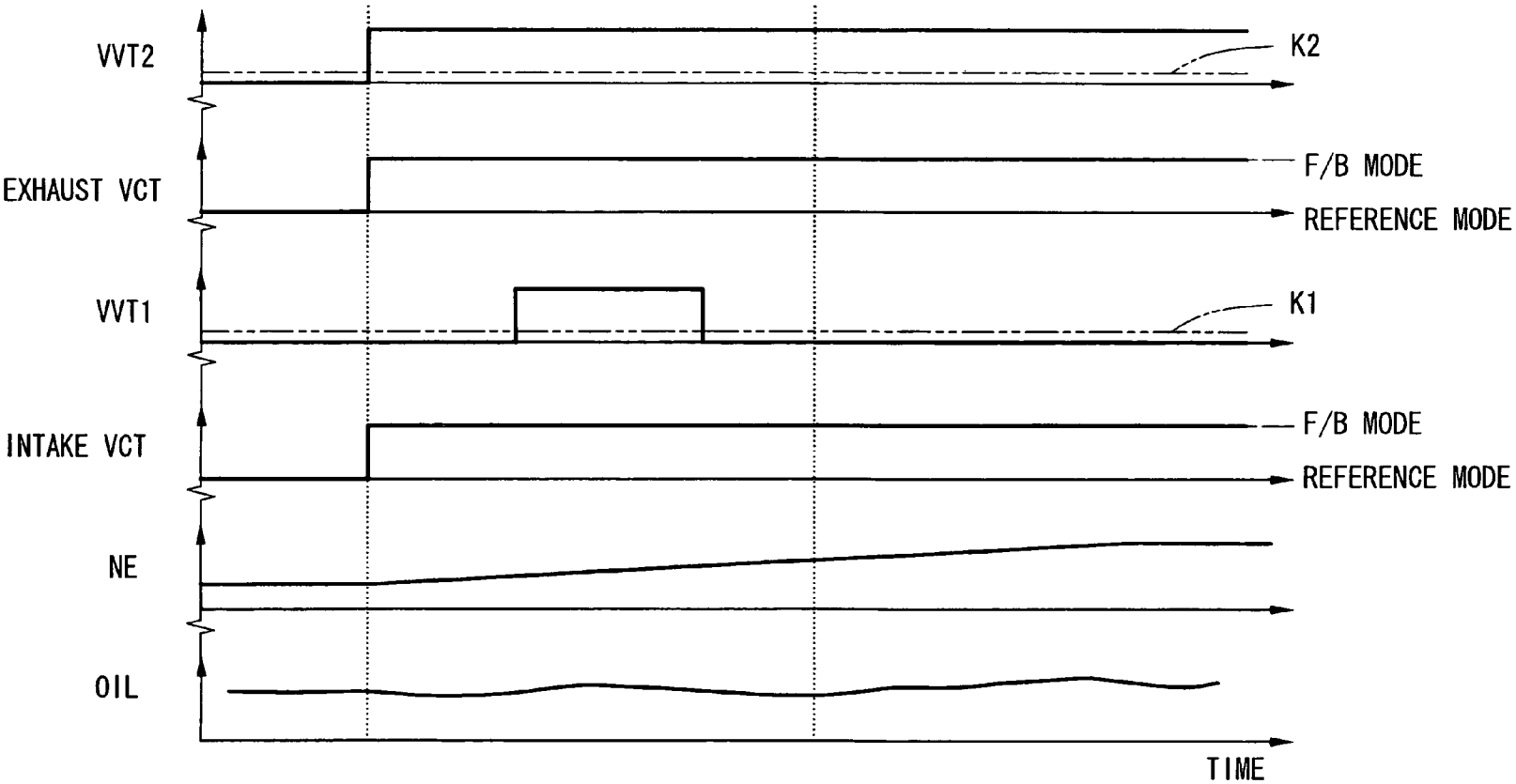
FIG. 10 PRIOR ART
FIG. 10 is a time chart showing an execution of the conventional valve timing control.

However, in the conventional valve timing control shown in FIG. 10, when the target advanced amount VTT1 of intake valve timing is lower than or equal to a switching threshold K1 and when the target retarded amount VTT2 of exhaust valve timing is lower than or equal to a switching threshold K2, the control modes of both the intake VCT 18 and the exhaust VCT 19 are switched to the reference timing control mode. The switching threshold K1 is the amount in which the intake valve timing advances by slight quantity from the most retarded timing. The switching threshold K2 is the amount in which the exhaust valve timing retards by slight quantity from the most advanced timing. When the target advanced amount VTT1 of the intake valve timing is larger than the switching threshold value K1, or when the target retarded amount VTT2 of exhaust valve timing is larger than the switching threshold K2, the control mode of both the intake VCT 18 and the exhaust VCT 19 is switched to the F/B control mode. Hence, the period of the F/B control mode becomes long, and the engine output may be lowered due to the increase in the amount of oil storage at the time of the F/B control mode.

Figure 9:
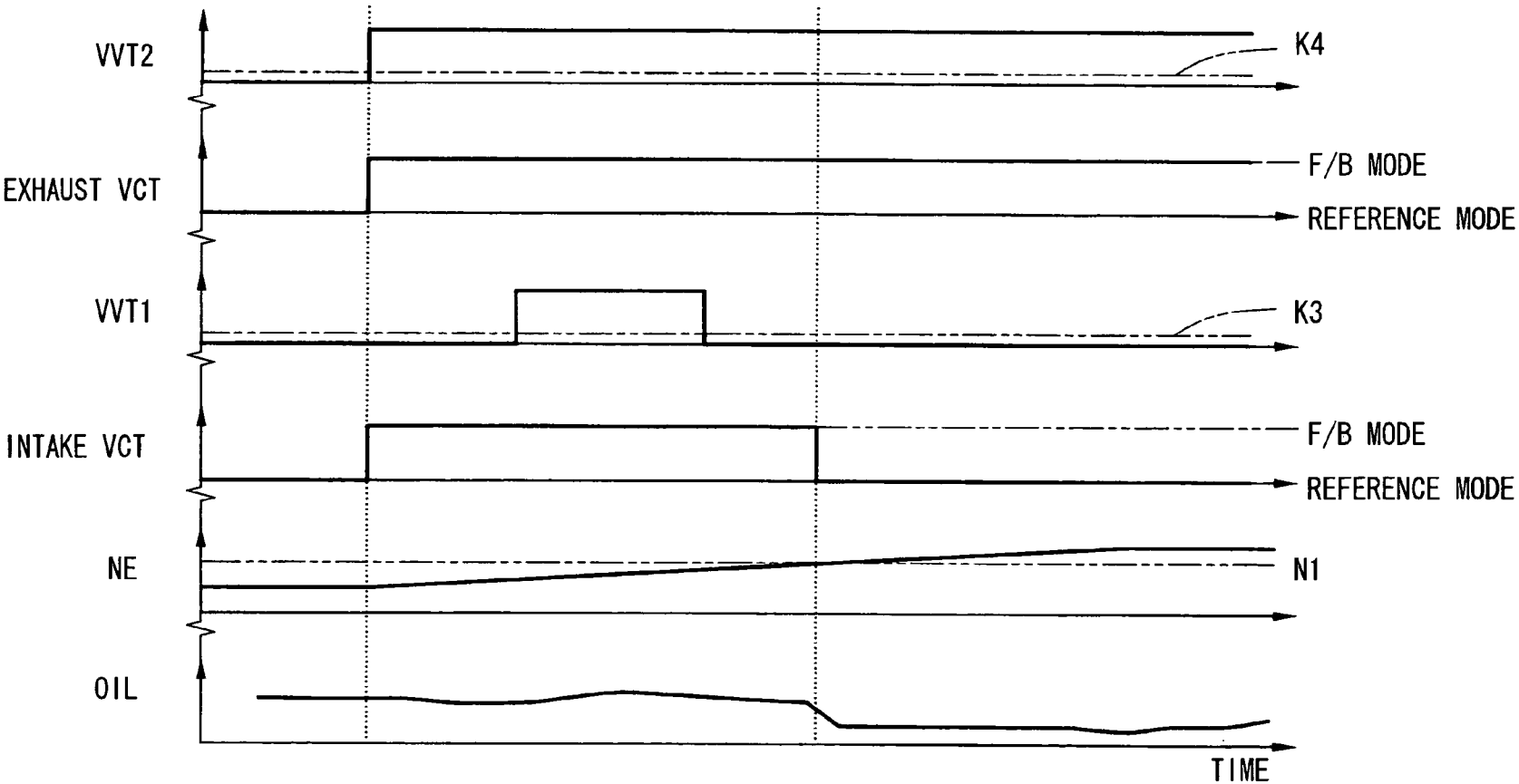
FIG. 9 is a time chart showing an execution of valve timing control according to the embodiment.

In the present embodiment shown in FIG. 9, when engine speed NE is more than a predetermined rotating speed N1, and when the target advanced amount VTT1 of intake valve timing is lower than or equal to a switching threshold K3, the control mode of the intake VCT 18 is switched to the reference timing control mode so that the intake valve timing is established as the most retarded timing (reference timing). That is, the actual advanced amount VT1 of the intake valve timing is established as the target advanced amount VTT1 or its approximate value. Furthermore, when the engine speed NE is more than or equal to the predetermined rotating speed N1, and when the target retarded amount VTT2 of exhaust valve timing is lower than or equal to the switching threshold K4, the control mode of the exhaust VCT 19 is switched to the reference timing control mode, and exhaust valve timing is controlled to the most advanced timing (reference timing). That is, the actual advanced amount VT2 of the exhaust valve timing is established as the target retarded amount VTT2 or its approximate value. The switching threshold K3 is the amount in which the intake valve timing advances by a slight quantity from the most retarded timing. The switching threshold K4 is the amount in which the exhaust valve timing retards by a slight quantity from the most advanced timing.

Thereby, the period which controls the intake VCT 18 and the exhaust VCT 19 by the F/B control mode becomes shorter than the conventional valve timing control. The period in which the amount of oil storage increases at the F/B control mode is decreased.

Moreover, the following problems occur in the system which supplies hydraulic pressure with the hydraulic pump 23 common to the intake side oil pressure regulating valve 28 and the exhaust side oil pressure regulating valve 29. Namely, in the low revolution area of the engine 11 in which the hydraulic pressure supplied to each oil pressure regulating valves 28 and 29 falls, if the control mode of one of the VCT 18 and 19 is switched during the period when the other VCT is controlled by the F/B control mode, the hydraulic pressure (hydraulic amount) supplied to the other VCT may be fluctuated.

As shown in FIG. 9, in valve timing control of this embodiment, when the engine speed NE is lower than the predetermined rotating speed N1, target advanced amount VTT1 of intake valve timing is lower than or equal to the switching threshold K1, and when the target retarded amount VTT2 of exhaust valve timing is less than or equal to the switching threshold K2, the control mode of both the intake VCT 18 and the exhaust VCT 19 is switched to the reference timing control mode. When the target advanced amount VTT1 of intake valve timing is larger than the changing threshold K1, or when the target retarded amount VTT2 of exhaust valve timing is larger than the switching threshold K2, the control mode of both the intake VCT 18 and the exhaust VCT 19 is switched to the F/B control mode.

Accordingly, when the engine speed NE is lower than the predetermined rotating speed N1, that is, when the hydraulic pressure (hydraulic amount) supplied to one VCT of the intake VCT 18 and the exhaust VCT 19 may be fluctuated by switching the control mode of the other VCT, the control modes of both the intake VCT 18 and the exhaust VCT 19 are simultaneously switched to the same control mode, so that the change of the control mode of the other VCT is prevented while one VCT is controlled in the F/B control mode.

Hereafter, the processes of each program for valve timing control shown in FIGS. 3 to 8 are explained.

[Switching of the Control Mode]

At step 101, it is determined whether engine speed NE is lower than the predetermined rotating speed N1.

When it is determined that the engine speed NE is lower than the predetermined rotating speed N1 at step 101, it is determined that the hydraulic pressure (hydraulic amount) supplied to one VCT may be fluctuated by switching the control mode of the other VCT. And the control mode of both the intake VCT 18 and the exhaust VCT 19 is simultaneously switched to the same control mode as follows.

At step 102, it is determined whether the target advanced amount VTT1 of intake valve timing is larger than the switching threshold K1. That is, it is determined whether it is in the intake side F/B control mode. This switching threshold K1 is established as the advance amount in which the intake valve timing advances by slight quantity from the most retarded timing.

When it is determined at step 102 that the target advanced amount VTT1 of the intake valve timing is less than or equal to the switching threshold K1 (that is, it is in the intake side reference timing control mode), procedure proceeds to step 103. At step 103, it is determined whether target retarded amount VTT2 of exhaust valve timing is larger than the switching threshold K2. That is, it is determined whether it is in the exhaust side F/B control mode. This switching threshold K2 is established as the retard value in which the exhaust valve timing retards by slight quantity from the most advanced timing.

When it is determined at step 102 that target advanced amount VTT1 of intake valve timing is less than or equal to the switching threshold K1, and when target retarded amount VTT2 of exhaust valve timing is determined less than or equal to the switching threshold K2 at step 103, the procedure proceeds to step 104. At step 104, the control modes of both the intake VCT 18 and the exhaust VCT 19 are simultaneously switched to or held at the reference timing control mode.

Figure 5:
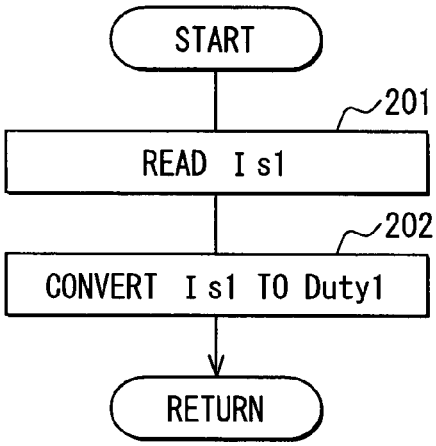
FIG. 5 is a flowchart showing a process of the most retarded timing control program of intake valve timing.
Figure 6:
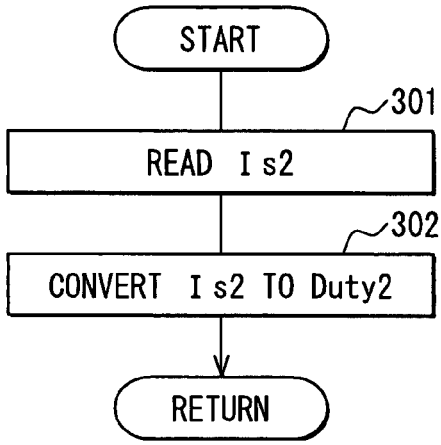
FIG. 6 is a flowchart showing a process of the most advanced timing control program of exhaust valve timing.

During the reference timing control mode, the most-retarded-timing control program of the intake valve timing, which is shown in FIG. 5, is executed at step 105, so that the actual advanced amount VT1 of intake valve timing is established as the most retarded timing (reference timing). At step 106, the most advanced timing control program of the exhaust valve timing shown in FIG. 6 is executed, and the actual advanced amount VT2 of exhaust valve timing is controlled to most advanced timing (reference timing).

On the other hand, when it is determined at step 102 that target advanced amount VTT1 of intake valve timing is larger than the switching threshold K1 (intake side F/B control mode), or when it is determined at step 103 that target retarded amount VTT2 of exhaust valve timing is larger than the switching threshold K2 (exhaust side F/B control mode), the procedure proceeds to step 107. At step 107, the control modes of both the intake VCT 18 and the exhaust VCT 19 are simultaneously switched to or held at the F/B control mode.

Figure 7:
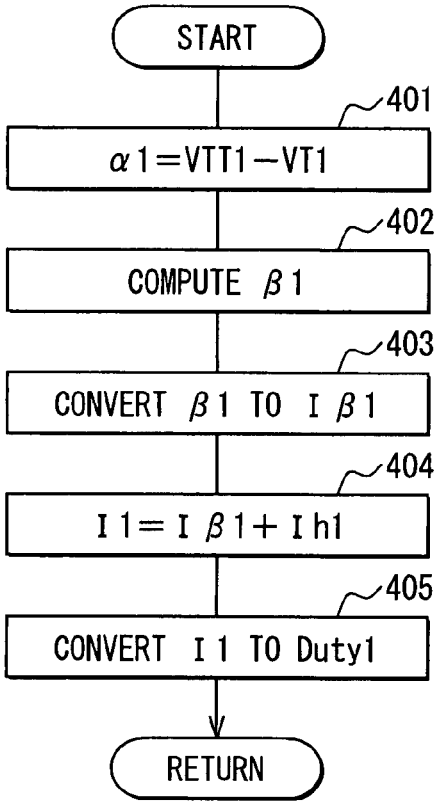
FIG. 7 is a flowchart showing a process of the F/B control program of intake valve timing.
Figure 8:
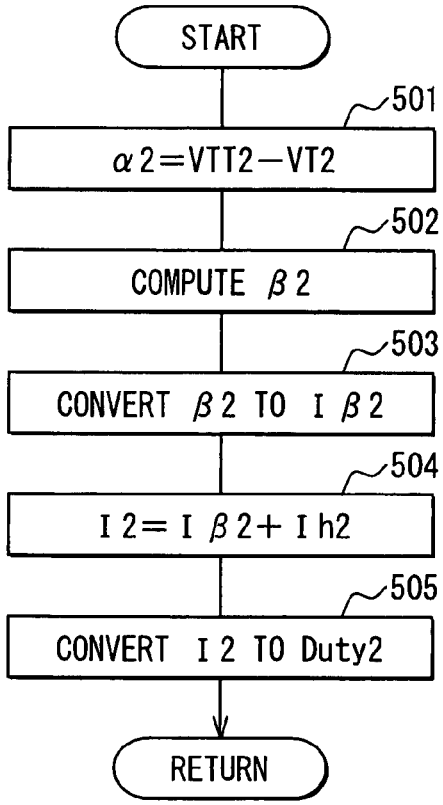
FIG. 8 is a flowchart showing a process of the F/B control program of exhaust valve timing.

During the F/B control-mode, the F/B control program of the intake valve timing shown in FIG. 7 is executed at step 108, and the oil pressure regulating valve 28 is controlled in such a manner that the difference between the target advanced amount VTT1 of the intake valve timing and the actual advanced amount VT1 is decreased. At step 109, the F/B control program of the exhaust valve timing shown in FIG. 8 is executed, and F/B control of the oil pressure regulating valve 29 of the exhaust VCT 19 is conducted so that the difference between the target retarded amount VTT2 and the actual advanced amount VT2 is decreased.

On the other hand, when it is determined at step 101 that the engine speed NE is more than or equal to the predetermined rotating speed N1, the procedure proceeds to step 110. At step 110, it is determined whether target advanced amount VTT1 of intake valve timing is larger than the switching threshold K3. That is, it is determined whether it is in the intake side F/B control mode. The switching threshold K3 is established as the advance amount in which the intake valve timing slightly advances from the most retarded timing.

When the answer is No at step 101 and when the answer is No at step 110, the procedure proceeds to step 111 in which the control mode of the intake VCT 18 is switched to or held at the reference timing mode. Then, the procedure proceeds to step 112 i which the most-retarded-timing control program of the intake valve timing shown in FIG. 5 is executed so that the actual advanced amount VT1 of intake valve timing is established as the most retarded timing (reference timing).

On the other hand, when it is determined that target advanced amount VTT1 of intake valve timing is larger than the switching threshold K3 (F/B control-mode territory) at step 110, the procedure proceeds to step 113 in which the control mode of the intake VCT 18 is switched to or held at the F/B control mode. Then, the procedure proceeds to step 114 in which the F/B control program shown in FIG. 7 is executed. The F/B control of the oil pressure regulating valve 28 is performed so that the difference between the target advanced amount VTT1 and the actual advanced amount VT1 id decreased.

Then, procedure proceeds to step 115 in which it is determined whether target retarded amount VTT2 of exhaust valve timing is larger than the predetermined switching threshold K4. That is, it is determined whether it is in the exhaust side F/B control mode. This switching threshold K4 is established as the retard value in which the exhaust valve timing slightly retarded from the most advanced timing.

As a result, when it is determined that the engine speed NE is larger than the predetermined rotating speed N1 at step 101, and when it is determined that target retarded amount VTT2 of exhaust valve timing is lower than or equal to the switching threshold K4 at step 115, the procedure proceeds to step 116 in which the control mode of the exhaust VCT 19 is switched to or held at the reference timing control mode. Then, the procedure proceeds to step 117 in which the most advanced timing control program of the exhaust valve timing shown in FIG. 6 is executed so that the actual advanced amount VT2 of exhaust valve timing is controlled to the most advanced timing (reference timing).

On the other hand, when it is determined that target retarded amount VTT2 of exhaust valve timing is larger than the switching threshold K4 (exhaust side F/B control mode) at step 115, the procedure proceeds to step 118 in which the control mode of the exhaust VCT 19 is switched to or held at the F/B control mode. Then, procedure proceeds to step 119 in which the F/B control program of the exhaust valve timing shown in FIG. 8 is executed. The F/B control of the oil pressure regulating valve 29 is executed so that the difference between the target retarded amount VTT2 and the actual advanced amount VT2 is decreased.

[Most Retarded Timing Control of Intake Valve Timing]

Figure 3:
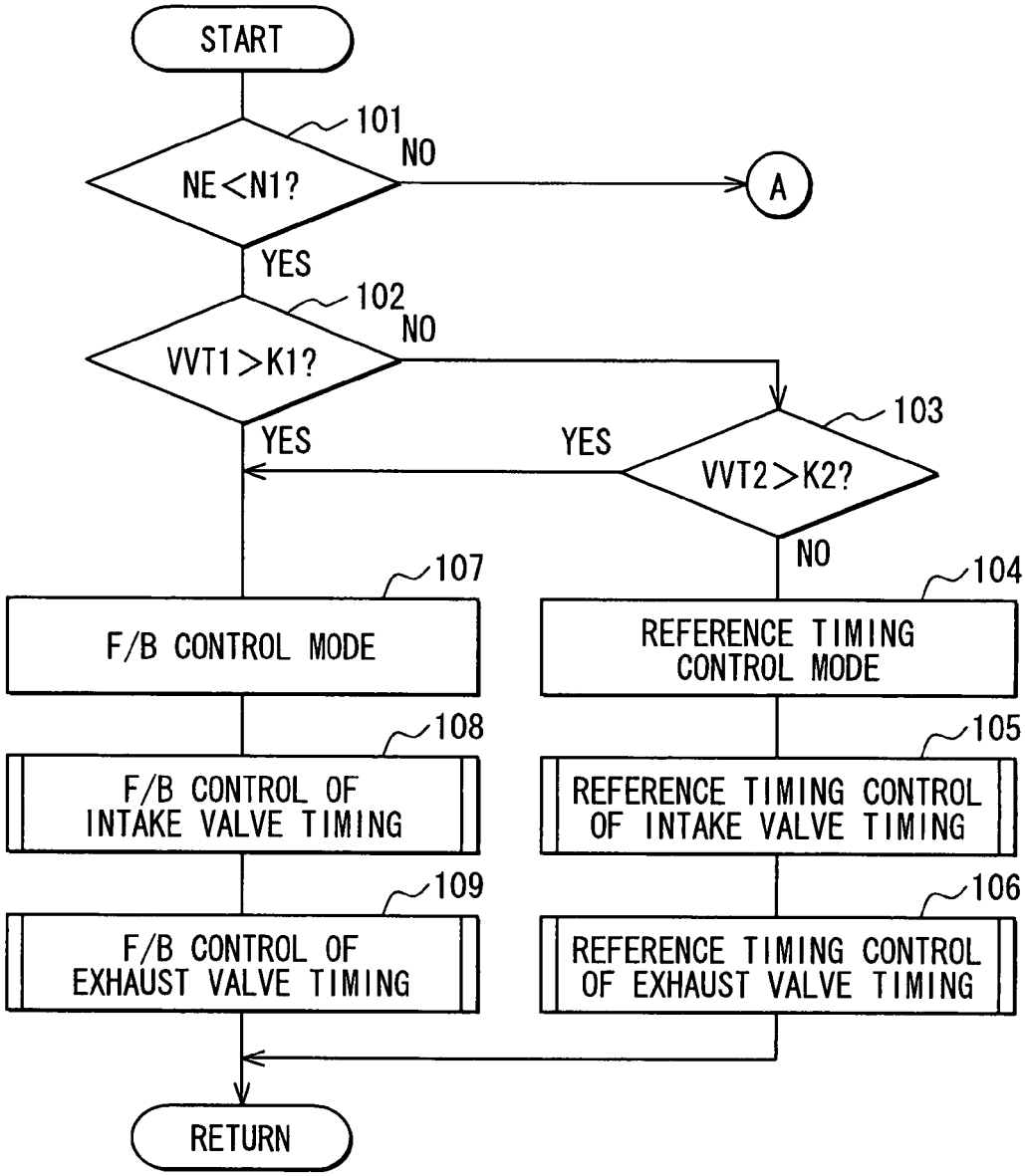
FIG. 3 is a flowchart showing a process of the control-mode change-over program.
Figure 4:
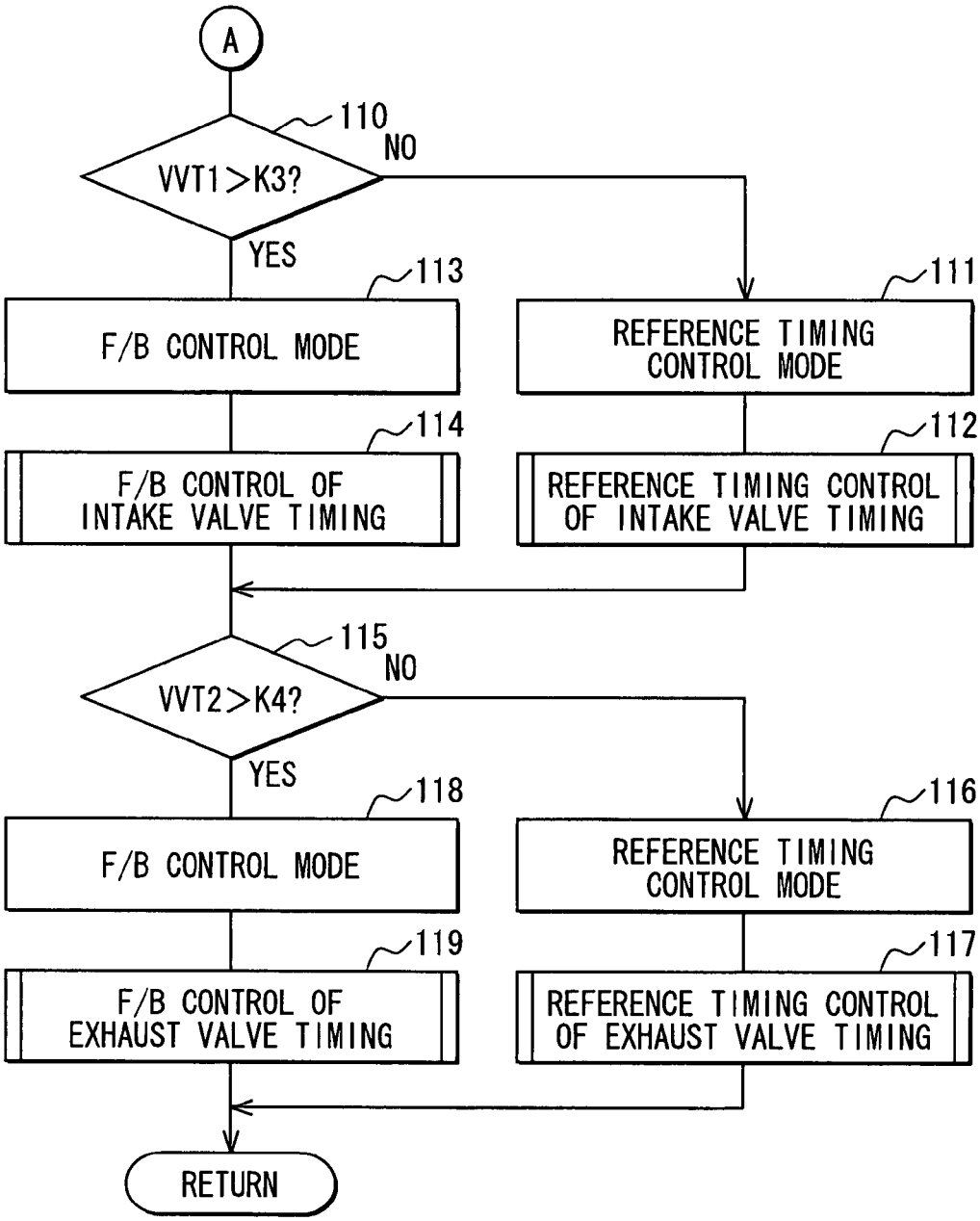
FIG. 4 is a flowchart showing a process of the control-mode change-over program.

At step 105 of FIG. 3, or step 112 of FIG. 4, the most-retarded-timing control program of the intake valve timing shown in FIG. 5 is executed. At step 201, the most retarded current value Is1 which is the drive current value of the oil pressure regulating valve 28 required to hold actual advanced amount VT1 of intake valve timing to most retarded timing is read from the memory of ECU31. This most retarded current value Is1 is established based on the feed oil flow rate characteristic of the oil pressure regulating valve 28 previously prepared based on the test data or the design data.

Then, the procedure proceeds to step 202 in which the most retarded current value Is1 is converted into control duty value Duty1. The duty control of the energization of the oil pressure regulating valve 28 is performed using this control duty value Duty1. Thereby, the driving current of the oil pressure regulating valve 28 is established as the most retarded current value Is1, and the actual advanced amount VT1 of the intake valve timing is held to the most retarded timing.

[Most Advanced Timing Control of Exhaust Valve Timing]

When the most advanced timing control program of the exhaust valve timing shown in FIG. 6 is started at step 106 or step 117, the most advanced timing control current value Is2 is read from the memory of ECU31 at step 301. The Most advanced timing control current value Is2 is the drive current value of the oil pressure regulating valve 29 required to hold actual advanced amount VT2 of exhaust valve timing at the most advanced timing. This most advanced timing control current value Is2 is established based on the feed oil flow rate characteristic of the oil pressure regulating valve 29 previously prepared based on the test data or the design data.

Then, the procedure proceeds to step 302 and converts the current value Is2 into control duty value Duty2. The Duty control of the energization of the oil pressure regulating valve 29 is performed using this control duty value Duty2. Thereby, the driving current of the oil pressure regulating valve 29 is controlled to the most advanced timing control current value Is2, and the actual advanced amount VT2 of exhaust valve timing is held to the most advanced timing.

[F/B Control of Intake Valve Timing]

At step 108 or step 114, the F/B control program of the intake valve timing shown in FIG. 7 is started. At step 401, the difference α1 between the target advanced amount VTT1 and the actual advanced amount VT1 is computed.

$$\alpha 1 = VTT1 - VT1$$

Then, the procedure proceeds to step 402 in which the F/B controlled variable β1 is computed by the PID control so that the difference α1 of target advanced amount VTT1 and actual advanced amount VT1 is decreased.

Then, the procedure proceeds to step 403 in which the F/B controlled variable β1 is converted into the F/B control current value Iβ1. Then, the procedure proceeds to step 404 in which the drive current value I1 is calculated by adding the F/B control current value Iβ1 to holding current value Ih1 (current value holding the present intake valve timing).

$$I1 = I\beta 1 + Ih1$$

Then, the procedure proceeds to step 405 in which the drive current value I1 is converted into the control duty value Duty1. The duty control of the energization of the oil pressure regulating valve 28 is performed using this control duty value Duty1. Thereby, the F/B control of the oil pressure regulating valve 28 is performed so that the difference α1 of target advanced amount VTT1 and actual advanced amount VT1 is decreased. And, the actual advanced amount VT1 of intake valve timing is consistent with the target advanced amount VTT1.

[F/B Control of Exhaust Valve Timing]

At step 109 or step 119, the F/B control program of the exhaust valve timing shown in FIG. 8 is started. At step 501, the difference α2 between the target retarded amount VTT2 and the actual advanced amount VT2 is computed.

$$\alpha 2 = VTT2 - VT2$$

Then, the procedure proceeds to step 502 in which the F/B controlled variable β2 is computed by the PID control so that the difference α2 between the target retarded amount VTT2 and the actual advanced amount VT2 is decreased.

Then, the procedure proceeds to step 503 in which the F/B controlled variable β2 is converted into the F/B control current value Iβ2. At step 504, the drive current value I2 is computed by adding the F/B control current value Iβ2 to a holding current value Ih2 (a current value holding the present exhaust valve timing).

$$I2 = I\beta 2 + Ih2$$

Then, the procedure proceeds to step 505 in which the drive current value I2 is converted into the control duty value Duty2. Duty control of the energization of the oil pressure regulating valve 29 is performed using this control duty value Duty2. Thereby, the F/B control of the oil pressure regulating valve 29 is performed so that the difference α2 between the target retarded amount VTT2 and the actual advanced amount VT2 is decreased. And, the actual advanced amount VT2 is coincided with the target retarded amount VTT2.

According to this example described above, when engine speed NE is more than or equal to the predetermined rotating speed N1, and when target advanced amount VTT1 is less than or equal to the switching threshold K3, the control mode of the intake VCT 18 is switched to the reference timing control mode. And when the engine speed NE is more than or equal to the rotating speed N1, and when the target retarded amount VTT2 is lower than or equal to the switching threshold K4, the control mode of the exhaust VCT 19 is switched to the reference timing control mode. Therefore, the period in which the intake VCT 18 and the exhaust VCT 19 is controlled in the F/B control mode can be made shorter than the conventional valve timing control. And the period in which the engine output is lowered by the increase in the amount of oil storage can be shortened.

Furthermore, according to this embodiment, when the engine speed NE is more than or equal to the predetermined rotating speed N1, the execution condition (the switching threshold K3 and K4) in which the control is switched to the reference timing control mode is individually established with respect to the intake VCT 18 and the exhaust VCT 19. Hence, the intake VCT 18 and the exhaust VCT 19 can be switched to the reference timing control mode on proper conditions respectively. The period in which the intake VCT 18 and the exhaust VCT 19 are controlled in the F/B control mode can be shortened, and the engine output can be improved.

Moreover, according to this embodiment, when the engine speed NE is lower than the predetermined rotating speed N1, the control modes of both the intake VCT 18 and the exhaust VCT 19 are simultaneously switched to the same control mode. Therefore, when the engine speed NE is lower than the predetermined rotating speed N1, that is, when the hydraulic pressure supplied to one VCT may be fluctuated by switching the control mode of the other VCT, the intake VCT 18 and the exhaust VCT 19 are simultaneously switched to the same control mode. Therefore, it is prevented that the control mode of VCT is changed during the period in which the other VCT is controlled by the F/B control mode. It is prevented that the hydraulic pressure (capacity) supplied to one VCT is fluctuated by the switch of the control mode of the other VCT. A fluctuation of actual valve timing can be restrained and a valve timing control precision can be improved.

Besides, in the above-mentioned embodiment, the switching to the reference timing control mode of the intake VCT 18 and the exhaust VCT 19 are determined at the same engine speed N1. The engine speed which determines the switch to the reference timing control mode by the intake VCT 18 and the exhaust VCT 19 may be established independently.

Moreover, the switching threshold K4 may be suitably changed in the range in which no adverse effect on operation of the internal combustion engine is affected. For example, the switching threshold K3 of the intake VCT 18 may be established as the timing position significantly advanced from the reference timing, or the switching threshold K4 of the exhaust VCT 19 may be established as the timing position significantly retarded from the reference timing.

Moreover, when engine speed is more than predetermined rotating speed N1, the intake VCT 18 and the exhaust VCT 19 may always be switched to the reference timing control mode. By controlling the actual valve timing to the reference timing, the actual valve timing can be established as the target valve timing or its vicinity.

Moreover, the switching characteristics of the control mode may have the hysteresis characteristic. That is, the engine speed at which the reference timing control mode is switched into the F/B control mode is different from the engine speed at which the F/B control mode is switched into the reference timing control mode. According to this structure, the hunting that the control mode of the VCT 18 and 19 switches frequently between the reference timing control mode and the F/B control mode by slight fluctuation of engine speed can be prevented beforehand.

Furthermore, switching threshold K1-K4 in the case of switching the reference timing control mode to the F/B control mode and switching threshold K1-K4 in the case of switching the F/B control mode to the reference timing control mode may be established as the different value, so that the hysteresis characteristic may be provided. According to this structure, the hunting that the control modes of VCT 18 and 19 are frequently switched between the reference timing control mode and the F/B control mode by the slight variation (fluctuation) of target advanced amount VTT1 or target retarded amount VTT2 can be prevented beforehand.

Moreover, although this invention is applied to the system equipped with both the intake VCT 18 and the exhaust VCT 19 in the above mentioned embodiment, this invention can be applied to the system equipped only with one of the intake VCT 18 and the exhaust VCT 19.

Moreover, although the reference timing of the intake VCT 18 is set at the most retarded timing and the reference timing of the exhaust VCT 19 is set at the most advanced timing in the above-mentioned embodiment, it is not limited to this. The intermediate position between the most retarded timing and the most advanced timing can be set as the reference timing of the intake VCT 18 or the exhaust VCT 19.

What is claimed is:

1. A variable valve timing controller for an internal combustion engine having a hydraulic variable valve timing device which hydraulically varies a valve timing of an intake valve and/or an exhaust valve of the internal combustion engine, comprising:

a control mode switching means for switching a control mode of the hydraulic variable valve timing device between a reference timing control mode in which a hydraulic pressure is controlled to a specified value so that an actual valve timing is brought into a reference timing, and a feedback control mode in which a hydraulic pressure is feedback controlled so that a difference between the actual valve timing and a target valve timing is decreased, wherein the control mode switching means switches the control mode of the variable valve timing device to the reference timing control mode, when the rotating speed of the internal combustion engine is greater than or equal to a specified value.

2. A variable valve timing controller for an internal combustion engine according to claim 1, wherein when the rotating speed of the internal combustion engine is greater than or equal to the specified value, and when the target valve timing is in a predetermined range, the control mode switching means switches the control mode of the variable valve timing device to the reference timing control mode.

3. A variable valve timing controller for an internal combustion engine according to claim 1, wherein the switching characteristics of the control mode of the variable valve timing device have the hysteresis characteristic with respect to a rotating speed of the internal combustion engine.

4. A variable valve timing controller for an internal combustion engine according to claim 1, comprising:

a hydraulic intake variable valve timing device which varies the valve timing of the intake valve of the internal combustion engine; and a hydraulic exhaust variable valve timing device which varies the valve timing of the exhaust valve of the internal combustion engine, wherein when the rotating speed of the internal combustion engine is greater than or equal to the specified value, the control mode switching means individually establishes execution conditions in which the control mode is switched into the reference timing control mode with respect to the intake variable valve timing device and the exhaust variable valve timing device.

5. A variable valve timing controller for an internal combustion engine according to claim 4, wherein in a case that the rotating speed of the internal combustion engine is lower than the specified value, when at least one of the intake variable valve timing device and the exhaust variable valve timing devices is brought into the F/B control mode, the control mode switching means switches the control modes of the intake variable valve timing device and the exhaust variable valve timing device into the F/B control mode simultaneously, and when the target valve timings of both the intake air side variable valve timing device and the exhaust side variable valve timing device are brought into the reference timing control mode, the control mode switching means switches the control mode of both the intake variable valve timing device and the exhaust variable valve timing device into the reference timing control mode simultaneously.

* * * * *